US011369169B2

(12) United States Patent
Redman et al.

(10) Patent No.: US 11,369,169 B2
(45) Date of Patent: Jun. 28, 2022

(54) SIMPLIFIED RATCHET STRAP AND BUCKLE ASSEMBLY

(71) Applicant: HEADKAYSE LIMITED, Altrincham (GB)

(72) Inventors: Andrew Redman, Altrincham (GB); George Fox, Altrincham (GB); Andrew Creak, Altrincham (GB); Anthony Walker, Altrincham (GB)

( * ) Notice: Subject to any disclaimer, the term of this patent is extended or adjusted under 35 U.S.C. 154(b) by 29 days.

(21) Appl. No.: 16/982,882

(22) PCT Filed: Mar. 22, 2019

(86) PCT No.: PCT/EP2019/057341
§ 371 (c)(1),
(2) Date: Sep. 21, 2020

(87) PCT Pub. No.: WO2019/180259
PCT Pub. Date: Sep. 26, 2019

(65) Prior Publication Data

US 2021/0000223 A1 Jan. 7, 2021

(30) Foreign Application Priority Data

Mar. 22, 2018 (GB) ..... 1804575

(51) Int. Cl.
*A44B 11/06* (2006.01)
*A42B 3/08* (2006.01)

(52) U.S. Cl.
CPC ..... *A44B 11/065* (2013.01); *A42B 3/08* (2013.01); *Y10T 24/45246* (2015.01)

(58) Field of Classification Search
CPC . A44B 11/065; Y10T 24/21; Y10T 24/45225; Y10T 24/2183; Y10T 24/45246; A42B 3/145
See application file for complete search history.

(56) References Cited

U.S. PATENT DOCUMENTS 4,727,630 A 3/1988 Alan
6,163,941 A * 12/2000 Lai ..... A43C 11/1413 24/191
6,219,889 B1 4/2001 Lovato et al.
(Continued)

FOREIGN PATENT DOCUMENTS

JP 2017082368 A 5/2017
WO 2014165856 A2 10/2014

OTHER PUBLICATIONS

Combined Search and Examination Report issued in GB Application No. GB1804575.7 dated Sep. 24, 2018, 8 pages.
(Continued)

*Primary Examiner* — Robert Sandy
*Assistant Examiner* — Michael S Lee
(74) *Attorney, Agent, or Firm* — RC Trademark Company

(57) ABSTRACT

Disclosed is a ratchet strap and buckle assembly comprising an adjustment ratchet strap comprising a ratchet strap end, and a plurality of ratchet teeth arranged thereon and a single-piece buckle having a locking tooth and a flexible top element, wherein the single-piece buckle comprises a passageway for the ratchet strap end to be inserted therein, and wherein the flexible top element is configured to engage with at least one of the plurality of ratchet teeth using the locking tooth upon insertion.

11 Claims, 4 Drawing Sheets

(56) References Cited

U.S. PATENT DOCUMENTS

| | | | | |
|---|---|---|---|---|
| 6,457,210 | B1 | 10/2002 | Shirai et al. | |
| 7,089,603 | B2 * | 8/2006 | Ketterer | A42B 3/145 2/418 |
| 8,474,113 | B2 * | 7/2013 | Badrenas Buscart | A44B 11/266 24/634 |
| 10,405,612 | B1 * | 9/2019 | Chan | A44B 11/12 |
| 10,773,042 | B2 * | 9/2020 | Rummery | A61M 16/06 |
| 2002/0189056 | A1 | 12/2002 | Gallina et al. | |
| 2004/0154139 | A1 | 8/2004 | Crook | |
| 2006/0101560 | A1 * | 5/2006 | Ketterer | A42B 3/145 2/418 |
| 2007/0234523 | A1 * | 10/2007 | Laks | A43C 11/06 24/1 |
| 2010/0175232 | A1 | 7/2010 | Shirai et al. | |
| 2010/0281661 | A1 | 11/2010 | Harada et al. | |
| 2011/0290840 | A1 * | 12/2011 | Huang | B60R 9/10 224/539 |
| 2013/0047384 | A1 * | 2/2013 | Carnevali | B65D 63/1063 24/265 CD |
| 2014/0216472 | A1 * | 8/2014 | Brace | A41D 13/1161 128/863 |
| 2015/0033457 | A1 * | 2/2015 | Tryner | A42B 3/328 2/421 |

OTHER PUBLICATIONS

International Search Report and Written Opinion of the International Searching Authority mailed in PCT Application No. PCT/EP2019/057341 dated Jul. 16, 2019, 12 pages.

International Preliminary Report on Patentability and Written Opinion of the International Searching Authority issued in PCT Application No. PCT/EP2019/057341 dated Sep. 22, 2020, 7 pages.

Examination Report issued in GB Application No. GB1804575.7 dated Jan. 13, 2021, 3 pages.

* cited by examiner

SECTION A-A

SECTION B-B

SIMPLIFIED RATCHET STRAP AND BUCKLE ASSEMBLY

TECHNICAL FIELD

The present disclosure relates to a ratchet strap and buckle assembly, in particular, which is suitable for adjustably pulling together webbing straps of helmet harnesses and other sporting goods.

BACKGROUND

This invention relates to a ratchet strap and buckle assembly, in particular, which is suitable for adjustably pulling together webbing straps of helmet harnesses and other sporting goods.

More specifically, this invention relates to a lower-cost single-piece moulded buckle, that functions similarly to existing multi-part ratchet buckles.

Known ratchet strap and buckle assemblies allow, as a functionality, a toothed ratchet strap to slide into a buckle and be held therein, until they are purposefully released. These ratchet strap and buckle assemblies are often used in helmets, hats and ski boots for fastening and fine adjustment purposes, or rear size adjustment purposes.

A problem has been, to achieve this aforesaid functionality, the ratchet buckle assembly requires use of a mechanism including multiple components to be employed including at least a case, a ratchet pawl, a plastic cam and a return spring. In order to resist relatively high loads, at least some parts of the mechanism may need to be made up of (namely, fabricated from) a high strength metallic material, which makes such a ratchet buckle assembly expensive to produce and possibly heavy.

An overall challenge then to be addressed is how to reduce the number of components required to assemble the buckle, whilst achieving a sufficiently strong retention of the strap in the buckle.

Furthermore, the aforementioned conventional ratchet buckle assembly is also employable in a cycle/motorsports helmet as a retention strap. When a given user's cycle/motorsports helmet comes under an impact with large objects such as automobiles, trees or roads (highways), the retention strap experiences heavy forces, which potentially cause a failure of the retention strap, thus causing injury to the given user. The retention strap potentially also tightens around a throat of the given user and risks causing suffocation if a harness structure cannot be activated by the user.

Various people have attempted to evolve new designs of ratchet buckles, but recent innovations have mainly been concerned with producing dual pawl ratchet designs for snowboard boot bindings, that provide a way to crank on higher tensions to straps of the new design of ratchet buckles.

Other attempts at simplifying buckle assembly designs include those shown in published patent applications U.S. Pat. No. 6,163,941A1 and CA2011579A1, both of which show buckle designs consisting of just two parts, namely a base and a retaining pawl. Both of these designs incorporate spring features on the pawl itself, which when the pawl is pulled away from the ratchet teeth, act against the base to push the pawl back into its engaged rest position.

Therefore, in light of the foregoing problems encountered with known art, there exists a need to overcome aforementioned drawbacks associated with conventional ratchet buckle assemblies and provide an improved type of ratchet buckle assembly that can be manufactured as one single injection moulded part.

SUMMARY

A main aim of the present disclosure is to provide a simple and inexpensive ratchet strap and buckle assembly, where the buckle itself is formed as one single moulded component. This assembly functions to enable the user to easily engage, adjust and lock the effective length of the strap, which stays in place during use, and which the user can easily release when desired.

A further aim of the present disclosure is to provide a quick lock, adjust and release ratchet strap and buckle assembly, wherein the strap and buckle assembly is connectable to webbing straps, to form the chin strap for a variety of helmets.

In accordance with a first aspect of the present invention, there is provided a strap with a number of ratchet teeth formed on its upper surface, and a hollow buckle part. The single hollow buckle part is formed by injection moulding to include a flexible spring area on its top side, joined only at a front end thereof. In this way, this top spring side can then flex up and down around this joined end. Furthermore, there is included one locking tooth formed on the underside of the sprung top section.

When the strap is inserted into a correspondingly shaped hollow inside the buckle, the sloped side of the ratchet teeth push up on the underside of the buckle tooth, flexing up the sprung top of the buckle, to allow entry. As the strap is pushed further past the engagement point of each strap tooth, the sprung buckle tooth drops down behind that ratchet strap tooth, preventing the strap from pulling back out again. This means that the user can select the number of ratchet teeth on the strap he/she wishes to be engaged to find the correct length of tension he/she desires.

To release the strap, the user can simply pull the sprung top of the buckle away from the ratchet teeth, to disengage the locking tooth and to allow the strap to pull out of the enclosing buckle.

In addition, to help with this release action, the sprung top can include some form of grip feature that makes it easier for the user to pull the sprung top of the buckle to release, including for example a simple hole in the end of the sprung section that a small webbing or cord 'pull tag' can be attached around.

Further important aspects of the buckle that allow it to function as a single part are:

a) a stop feature that prevents the sprung top being pulled any further than necessary to release the strap (and thereby preventing it from being damaged); and b) a cut away or 'necked' area of the sprung top, which allows a larger area of the joined rear material to flex whilst reducing peak stresses that potentially cause material failure.

In addition, to make this assembly function as a helmet chin strap buckle, the strap and corresponding internal shape and underside of the buckle are formed in a curved shape to fit more comfortably the underside of the chin. Simplifying the moulding process results in a trumpet-shaped interior cross-section, which provides less support to the ratchet strap, and therefore the present invention includes extra support bars in the roof to stabilise the ratchet strap inside the buckle and prevent inadvertently triggering release though general movement.

These features are described in more detail with reference to the accompanying drawings.

BRIEF DESCRIPTION OF THE DRAWINGS

The invention will be more clearly understood with reference to the following drawings, in which.

DETAILED DESCRIPTION OF EMBODIMENTS

Figure 1:
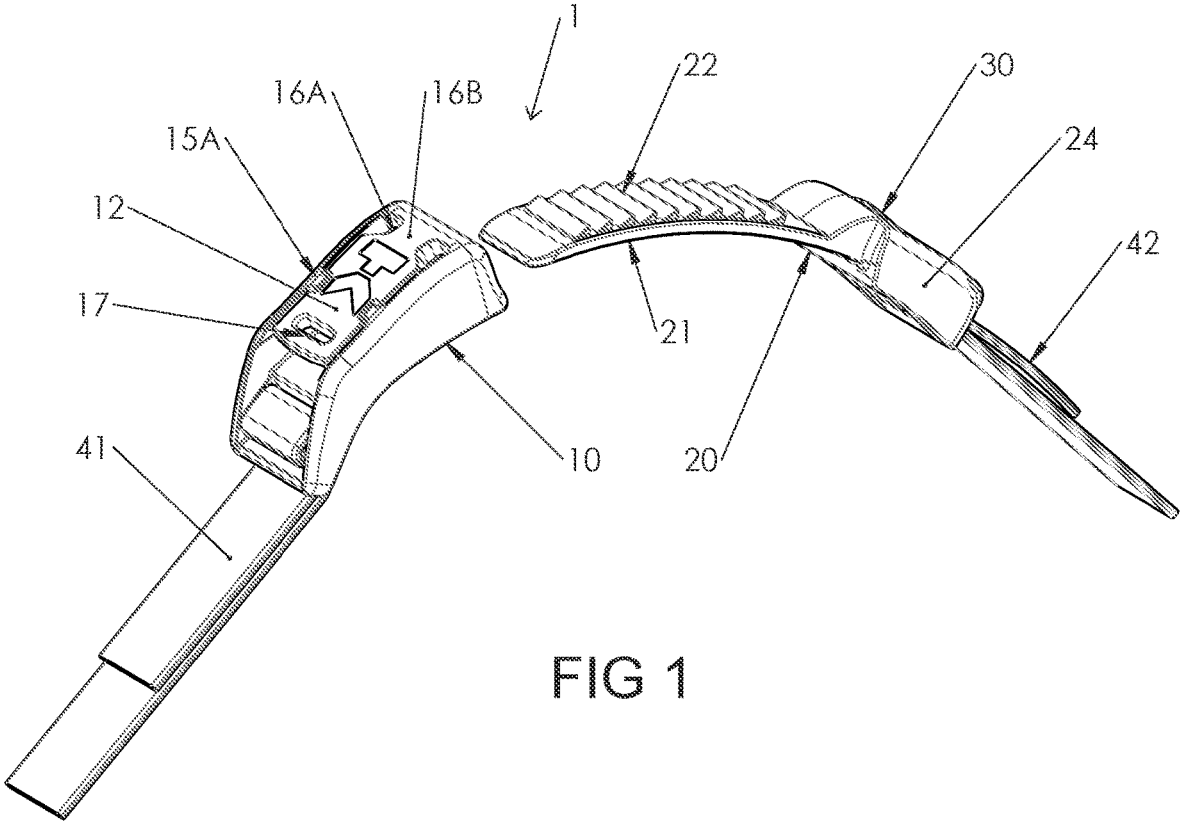
FIG. 1 is a perspective view of a ratchet strap and buckle that are mutually aligned, but not engaged, wherein both the ratchet strap and the buckle have webbing straps attached thereto.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

The present disclosure provides a ratchet strap and buckle assembly comprising:

- an adjustment ratchet strap comprising a ratchet strap end, and a plurality of ratchet teeth arranged thereon; and
- a single-piece buckle having a locking tooth and a flexible top element;

wherein the single-piece buckle comprises:

- a passageway for receiving the ratchet strap end to be inserted therein, and
- the flexible top element is configured to engage with at least one of the plurality of ratchet teeth using the locking tooth upon insertion of the adjustment ratchet strap, and
- a stop feature that is operable to regulate movement of the flexible top element; and
- a strap stabilisation feature that is operable to stabilise the adjustment ratchet strap inside the buckle and prevent inadvertently triggering release of the adjustment ratchet strap from the single-piece buckle through a general movement thereof.

Optionally, in the ratchet strap and buckle assembly, the flexible top element includes at least one cut-out that is operable to release stress generated by the movement of the flexible top element during engagement and/or disengagement with the ratchet teeth.

Optionally, in the ratchet strap and buckle assembly, the single-piece buckle comprises support bars inside the passageway to limit a range of vertical movement of the ratchet strap end. By limiting the range of vertical movement, a risk of unintentional release of the ratchet strap from the buckle is reduced, for example arising from a vigorous general movement of the ratchet strap and buckle assembly during use.

Optionally, in the ratchet strap and buckle assembly, the plurality of ratchet teeth are arranged perpendicularly to the direction of insertion into the single-piece buckle and are shaped with a sloping front face and vertical rear face.

Optionally, in the ratchet strap and buckle assembly, the adjustment ratchet strap and single-piece buckle are manufactured using a single injection-moulding technique.

Optionally, in the ratchet strap and buckle assembly, the ratchet strap end and the single piece buckle are manufactured from stiff, elastic and low friction material selected from a group including at least one of polypropylene, nylon, and acetal plastic.

Optionally, the stiff, elastic and low friction material has a Young's modulus in a range of 2200 to 4000 MPa, a yield stress greater than 40 MPa, and nominal strain at break greater than 40%.

Optionally, in the ratchet strap and buckle assembly, the adjustment ratchet strap and the single piece buckle comprises ladderlock bars for attachment of webbing therewith.

Optionally, in the ratchet strap and buckle assembly, the adjustment ratchet strap and single piece buckle is manufactured to have a curvature. More optionally, the curvature has a radius in a range of 70 mm to 100 mm.

Figure 2:
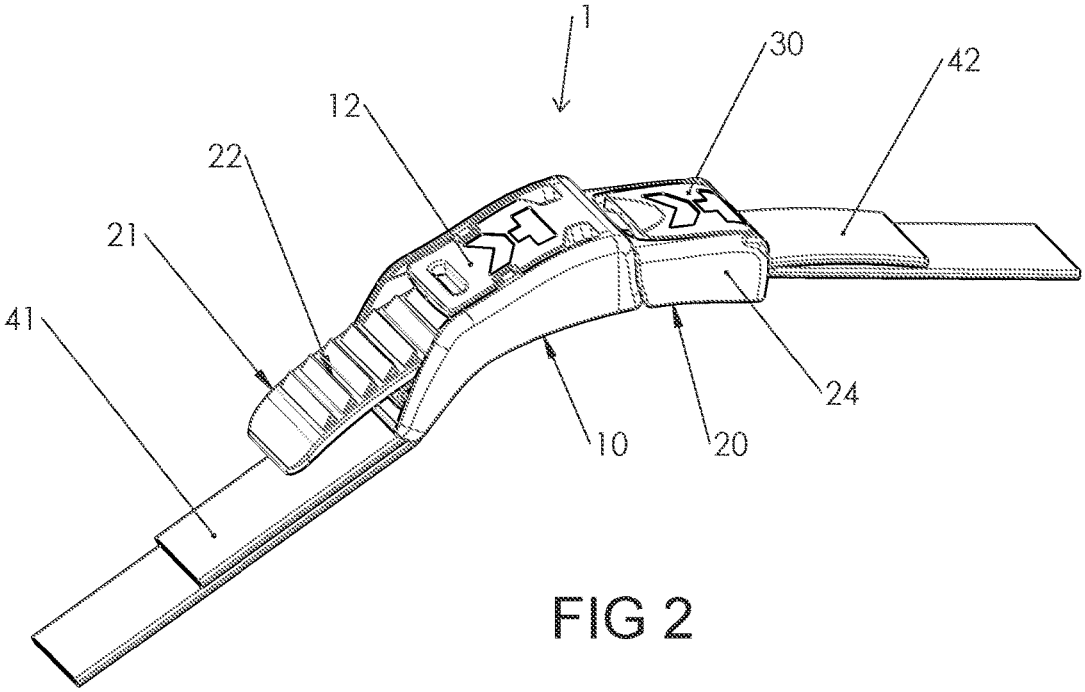
FIG. 2 is a similar perspective view to FIG. 1 showing the ratchet strap fully engaged within the buckle.
Figure 3:
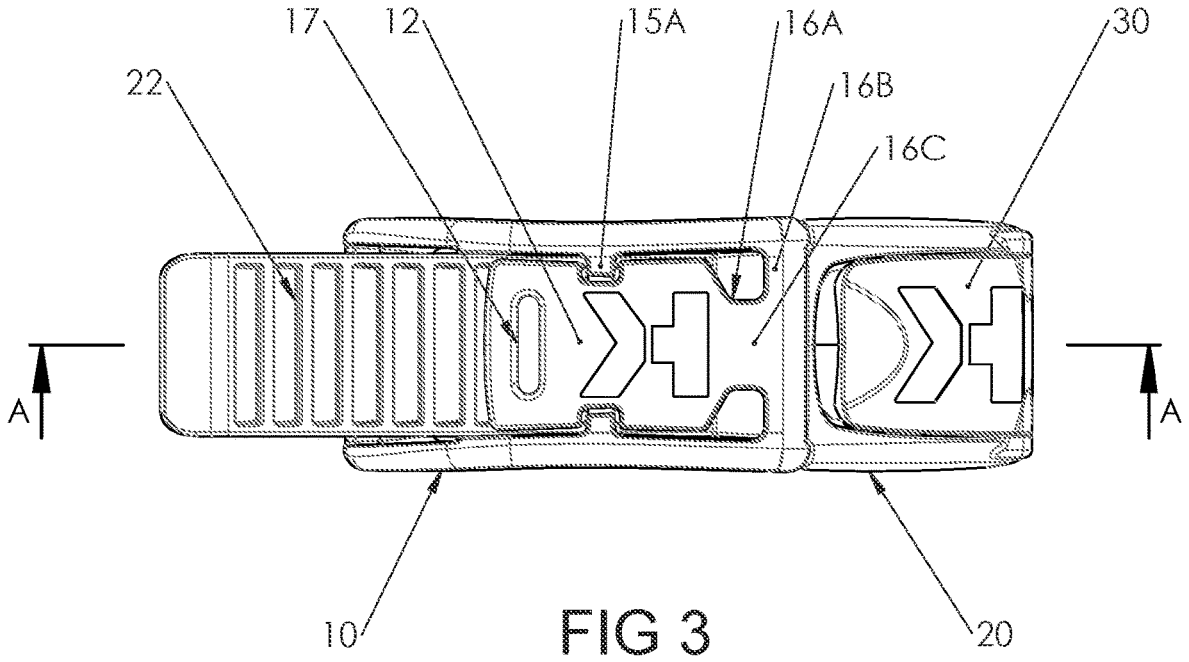
FIG. 3 is a top view of just the ratchet strap when fully engaged within the buckle, without any webbing, wherein there is also shown the position of the cross-section view AA shown in FIG. 4.

With reference to FIGS. 1 & 2 in the drawings, item 1 refers to an overall ratchet strap and buckle assembly, shown as a helmet retention strap embodiment of the present invention. The ratchet strap and buckle assembly 1 includes an adjustment ratchet strap 20 and a single-piece buckle 10.

Figure 4:
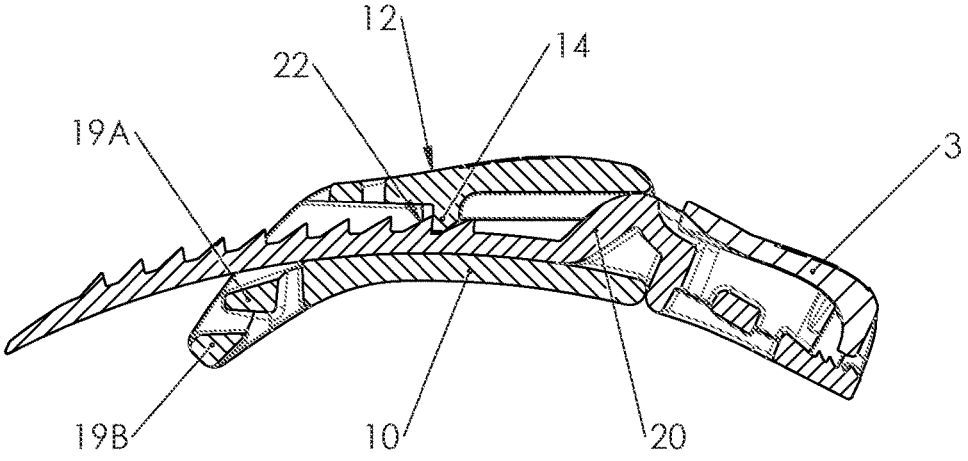
FIG. 4 is a cross-section AA view at the position as marked on FIG. 3.
Figure 5:
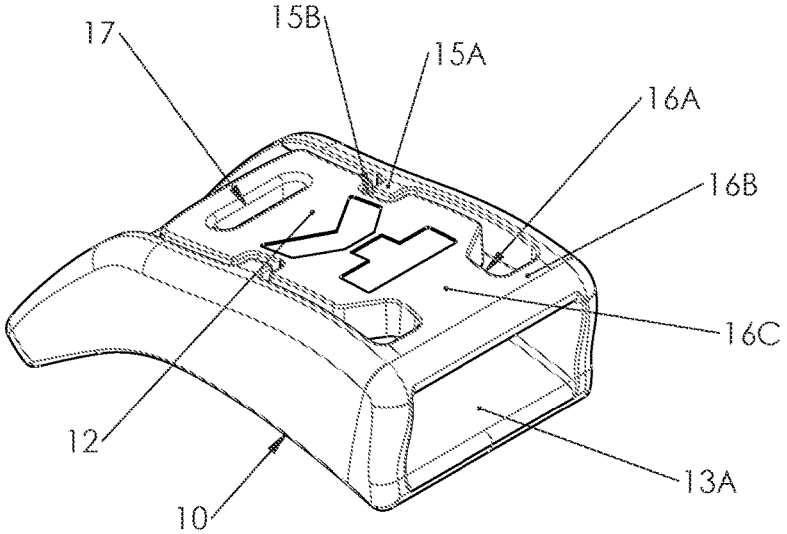
FIG. 5 is a ¾ perspective view of the buckle as viewed from its open receiving end.
Figure 6:
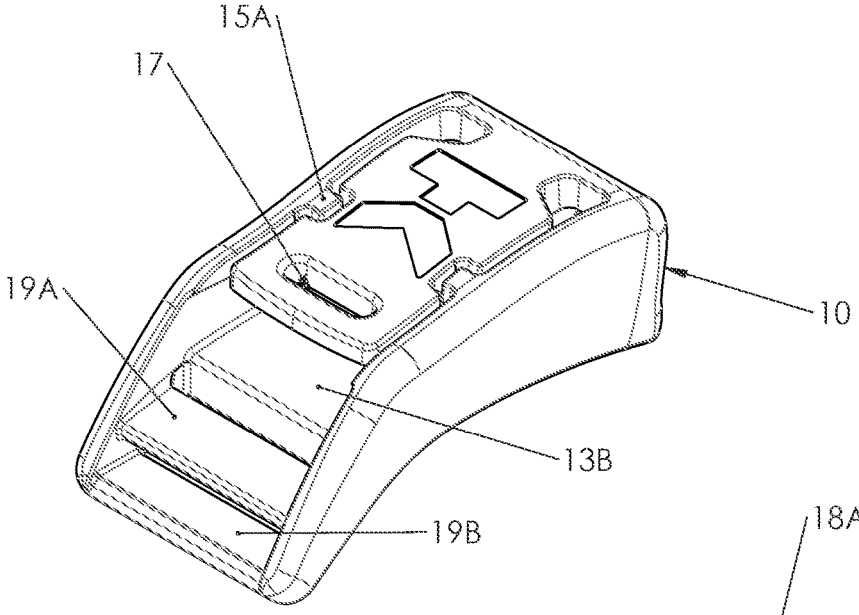
FIG. 6 is a ¾ perspective view of the buckle from an opposite end to FIG. 5.

The adjustment ratchet strap 20 has a front ratchet strap end 21 and a rear webbing strap connection end 24. The front ratchet strap end 21 includes a plurality of ratchet style teeth 22 that are formed on its upper surface, namely perpendicularly to the direction of insertion of the ratchet strap 20 into the buckle 10, shaped with a sloping front face and vertical rear face, which allow the strap 20 to be pushed into the buckle 10, but engage with the corresponding vertical tooth 14 in the buckle 10 which prevents it from coming apart, as shown in FIG. 4.

The rear webbing strap connection end 24 can be designed with any range of webbing attachment features, for example such a webbing attachment feature includes a simple bar for sewing a webbing 42 thereonto, or a more involved 'ladderlock' style adjustment feature. The version shown in this case in FIGS. 1 & 2 includes an additional cam clip webbing lock 30 which prevents the webbing strap 42 slipping after adjustment.

The single-piece buckle 10 is shaped as a hollow box, creating a passageway for receiving the ratchet strap end 21. Sides of this passageway are close-fitting to the ratchet strap 20 to keep it located centrally and in line with the single piece buckle 10.

Figure 10:
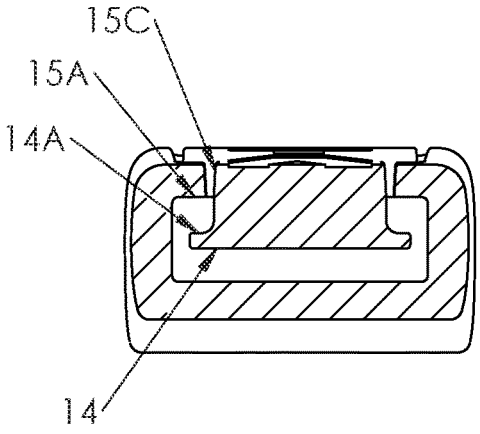
FIG. 10 is the cross-section BB view at the position marked on FIG. 8.

A top 12 of the buckle 10 is separated from a rest of the buckle 10 on three sides, by two channels (identified as 15C in FIG. 10) that run nearly a full length of a top of the buckle 10, leaving a front (receiving) end attached by material at both sides of cut out features 16B. These two channels 15C include cut out features 16A mirrored on both sides of the buckle 10 at this joined end, which allow a greater flexure in the material used, partially through bending in a central area 16C, but mainly through torsional strain in a joining area associated with the cut out features 16B. This improves the spring effect of a joining area associated with the cut out features 16B and reduces localised strain on the joining area, thereby helping to prevent material failure thereof.

There is also included a stop feature built into this top 12 of the buckle 10, which is a vital safety feature to prevent over bending the sprung top 12 and causing too much strain and failure in material that is used for fabricating the front joining area associated with the cut out features 16B. This stop feature is comprised of a small protruding ledge 15A formed in the dividing channel 15C, and a corresponding extension 14A in the end of the locking tooth 14. These features are also mirrored (namely implemented symmetrically) across the buckle 10. In a neutral position, the underside of the small protruding ledge 15A and the top of the small protruding ledge 15B are separated by a gap that is slightly larger than a height of one of the ratchet teeth 22, meaning that the sprung top 12 can be pulled up just far enough to release the locking tooth 14 from the ratchet strap 21, before the two stop features come into contact and prevent the sprung top 12 being deformed any further, under a normal finger pull load.

The design of the slot, including stop features 14A, 15A & 15B and the flex features 16A, 16B & 16C, allow for simple moulding in a single injection mould tool, with cores forming the hollow centre of the buckle creating 14A where they meet at the front of the locking tooth 14, whilst the shaped slot including 15A, 15B, 16A, 16B & 16C is formed by the top half of the tool, which meets with the cores forming the hollow on the inside of the buckle.

In addition, further curvature can be introduced to make the strap 20 function comfortably as an under-chin helmet retention strap. This further curvature requires curving the ratchet strap 20 and corresponding internal surfaces of the buckle 10 that touch the underside of this strap 20 and are in contact with the wearer's chin. This curvature can clearly be seen in FIG. 1, FIG. 2 and especially in FIG. 4, wherein there is illustrated in cross section an interaction between the curved strap 20 and buckle 10, internally.

Providing this curvature during manufacture introduces an injection moulding challenge, as forming a concentrically curved hollow inside the buckle 10 would require similarly curved core inserts that would retract on a same arc. A simpler alternative shown in FIG. 4 is to form the inside cavities of the buckle 10 with 'straight-pull' action core inserts, which allow the base of the buckle 10 to have a same curvature as that of the strap 20, but a straight top side to avoid an undercut problem, thereby forming a more trumpet-shaped internal cavity in both ends of the buckle 10.

This strap 20 and buckle 10, as described above, are easy to mould, but cause a small problem in that the strap 20 is now less well supported and can rock around vertically inside the buckle 10 when not under tension. Experimentation undertaken when innovating the strap 20 and buckle 10 found that pulling up on the strap end webbing 42 could allow the strap 20 to lever up and release the sprung buckle tooth 14, causing an undesired release of the strap 20.

Figure 7:
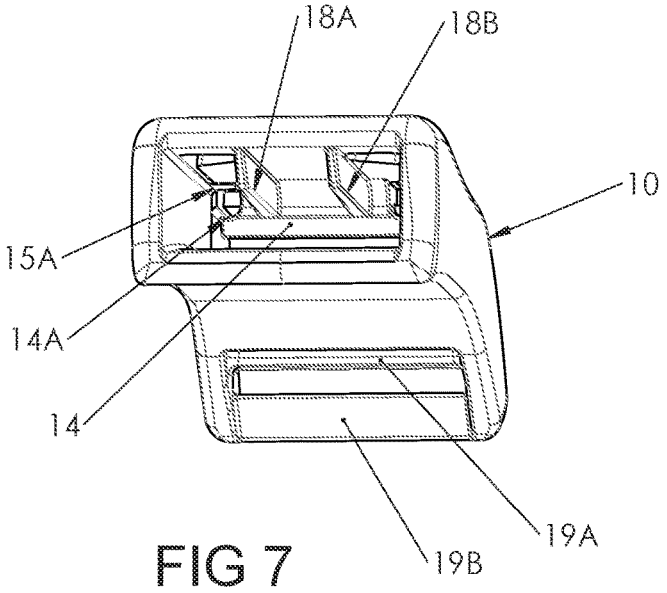
FIG. 7 is a perspective view into the front (receiving) end of the buckle.
Figure 8:
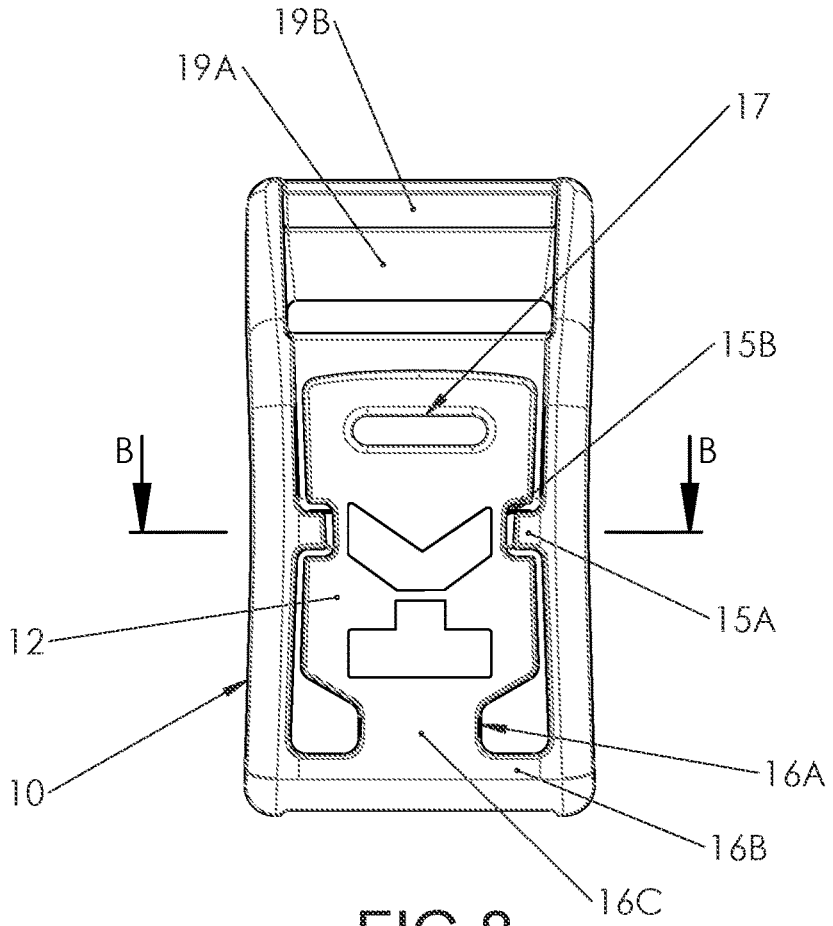
FIG. 8 is a top view of just the buckle, wherein there is shown a position of the cross-section view BB shown in FIG. 10.
Figure 9:
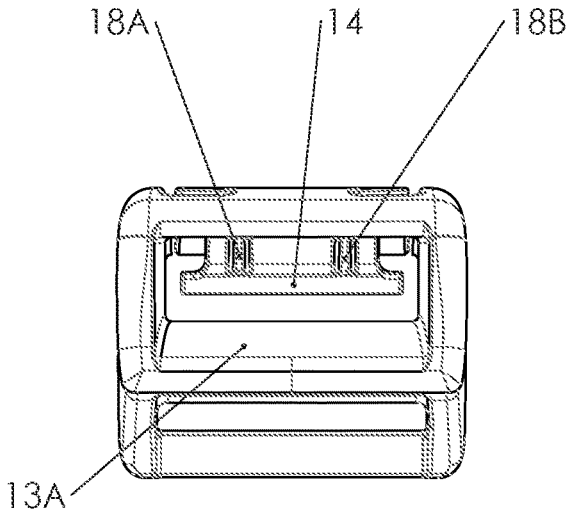
FIG. 9 is an end view of the buckle from the receiving end.

The present invention therefore also includes additional strap support features inside the buckle hollow 10. These additional strap support features beneficially include a variety of solutions, such as moulded-in channels in the sides of the buckle 10, or as shown here in FIGS. 7 and 9 by way of support bars 18A and 18B formed under the buckle top 12 starting at the front (receiving) end that run back into the lock tooth 14, which helps to limit the vertical movement of the strap 20. These support bars 18A and 18B are formed in such a way that they do not cause moulding problems.

The buckle 10 and ratchet strap 20 are preferably made from a tough, stiff but elastic and low friction material. Typically, suitable materials include, but are not limited to, polymeric plastics materials such as polypropylene, nylon, acetal plastic. In an embodiment, polypropylene material is used when the intended loads are relatively low.

In order to make this invention useful as a webbing strap buckle, this invention also includes two types of webbing locating features, that will next be described.

At the end of the buckle 10, there is included a webbing ladderlock, that includes two bars 19A and 19B. This ladderlock is orientated at a slightly more extreme angle than employed in conventional buckles, that further encourages the webbing to lock when the buckle 10 is hanging to reduce a chance of the buckle 10 losing its right length adjustment and, secondly, makes the bars 19A and 19B possible to mould (mold) with a combination of that end core and the base of the tool.

The ratchet strap end 21 includes similar locking bars (#), with grip features (#) arranged on a rearmost bar (#) which are pressed down by a base of an over-centre cam locking lever 30, which work together to trap the webbing. Such an arrangement enables the user to set a correct length of the webbing and then semi-permanently lock off this part of the webbing, overcoming an oft-cited prior art irritation of the webbing coming lose and having to be re-adjusted on bicycle helmets for example.

These webbing termination features are employed in one example embodiment of the invention, wherein the buckle and ratchet strap optionally terminate in any manner of webbing features or other fastening arrangements, such as a solid section with holes for screws or rivets, or welding features, to attach permanently the ratchet strap and the buckle onto another type of material.

By describing this beneficial embodiment, it is not intended to be limited to the beneficial embodiment. Whilst it will be apparent that the strap and buckle assembly of the present invention is particularly suitable for use in a retention harness of a sports helmet, with simple modification to shape or fastening features, it may also be used in a wide variety of applications in other fields, in which a strap and buckle assembly is required.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A ratchet strap and buckle assembly comprising:

an adjustment ratchet strap comprising a ratchet strap end, and a plurality of ratchet teeth arranged thereon; and a single-piece buckle having a locking tooth and a flexible top element;

wherein the single-piece buckle comprises:

a passageway for receiving the ratchet strap end to be inserted therein, and the flexible top element is configured to engage with at least one of the plurality of ratchet teeth using the locking tooth upon insertion of the adjustment ratchet strap, and wherein the flexible top element includes a central area between the top element and the buckle that flexes when in operation, wherein the central area has two cut out features to reduce local strain in the central area;

a stop feature that is operable to regulate movement of the flexible top element; and a strap stabilisation feature that is operable to stabilise the adjustment ratchet strap inside the buckle and prevent inadvertently triggering release of the adjustment ratchet strap from the single-piece buckle through a general movement thereof.

2. A ratchet strap and buckle assembly of claim 1, wherein the flexible top element includes at least one cut-out that is operable to release stress generated by the movement of the flexible top element during engagement and/or disengagement with the plurality of ratchet teeth.

3. A ratchet strap and buckle assembly of claim 2, wherein the at least one cut-out is operable to release a stress caused by a spring action of the flexible top element.

4. A ratchet strap and buckle assembly of claim 1, wherein the single piece buckle comprises support bars inside the passageway to limit a vertical movement of the ratchet strap end.

5. A ratchet strap and buckle assembly of claim 1, wherein the plurality of ratchet teeth are arranged perpendicularly to a direction of insertion of the adjustment ratchet strap into the single-piece buckle and shaped with a sloping front face and vertical rear face.

6. A ratchet strap and buckle assembly of claim 1, wherein the adjustment ratchet strap and single-piece buckle are manufactured using a single injection moulding technique.

7. A ratchet strap and buckle assembly claim 1, wherein the ratchet strap end and the single-piece buckle are manufactured from a stiff, elastic and low friction material selected from a group including at least one of polypropylene, nylon, acetal plastics materials.

8. A ratchet strap and buckle assembly of claim 7, wherein the stiff, elastic and low friction material has a Young's modulus in a range of 2200 to 4000 MPa, a yield stress greater than 40 MPa, and nominal strain at break greater than 40%.

9. A ratchet strap and buckle assembly of claim 1, wherein the adjustment ratchet strap and the single-piece buckle comprise ladderlock bars for attachment of webbing therewith.

10. A ratchet strap and buckle assembly of claim 9, wherein the adjustment ratchet strap and single-piece buckle are manufactured having a curvature, wherein the curvature has a radius in a range of 70 mm and 100 mm.

11. A ratchet strap and buckle assembly of claim 10, wherein the curvature of the ratchet strap and single-piece buckle comprises features that are operable to form an under-chin helmet retention strap for a variety of helmets.

* * * * *